US008068760B2

(12) United States Patent
Fukusaka

(10) Patent No.: US 8,068,760 B2
(45) Date of Patent: Nov. 29, 2011

(54) SHEET FEEDER AND IMAGE FORMING APPARATUS

(75) Inventor: Tetsuro Fukusaka, Abiko (JP)

(73) Assignee: Canon Kabushiki Kaisha (JP)

( * ) Notice: Subject to any disclaimer, the term of this patent is extended or adjusted under 35 U.S.C. 154(b) by 705 days.

(21) Appl. No.: 12/203,911

(22) Filed: Sep. 3, 2008

(65) Prior Publication Data

US 2009/0066010 A1 Mar. 12, 2009

(30) Foreign Application Priority Data

Sep. 6, 2007 (JP) ..... 2007-230879

(51) Int. Cl.
*G03G 21/20* (2006.01)
*G03G 15/00* (2006.01)

(52) U.S. Cl. ..... 399/97; 399/44; 399/92

(58) Field of Classification Search ..... 399/23, 399/44, 92, 97, 393; 271/145; 236/44 A; 347/101, 102, 152
See application file for complete search history.

(56) References Cited

U.S. PATENT DOCUMENTS

| | | | | |
|---|---|---|---|---|
| 4,727,385 | A * | 2/1988 | Nishikawa et al. | 347/152 |
| 5,930,558 | A * | 7/1999 | Raus et al. | 399/97 |
| 6,654,573 | B2 * | 11/2003 | Carlson et al. | 399/92 |
| 6,931,223 | B2 * | 8/2005 | Yamada | 399/97 |
| 7,657,202 | B2 * | 2/2010 | Taki et al. | 399/97 |

FOREIGN PATENT DOCUMENTS

| | | | |
|---|---|---|---|
| JP | 9-44063 | A | 2/1997 |
| JP | 2005-77762 | A | 3/2005 |

* cited by examiner

*Primary Examiner* — Sandra Brase
(74) *Attorney, Agent, or Firm* — Rossi, Kimms & McDowell LLP

(57) ABSTRACT

A sheet feeder which feeds a sheet in a sheet storage case includes a sheet storage case in which a sheet is stored, a dehumidifier which dehumidifies air, an air tank in which air dehumidified by the dehumidifier is stored, shutters and which bring the air tank and the sheet storage case into communication and out of communication, and fans and which send air between the air tank and the sheet storage case. The shutters and the fans are operated in accordance with humidity in the sheet storage case.

9 Claims, 7 Drawing Sheets

SHEET FEEDER AND IMAGE FORMING APPARATUS

BACKGROUND OF THE INVENTION

1. Field of the Invention

The present invention relates to a sheet feeder which feeds, from a storage case in which a plurality of sheets are stored, the sheets one-sheet by one-sheet, and the invention also relates to an image forming apparatus having the sheet feeder.

2. Description of the Related Art

When an image forming apparatus is used under a high humidity environment, transfer sheets stored in the apparatus absorbs humidity. Since transfer sheets which absorb humidity in a state where they are stacked in the apparatus absorb each other, there is a fear that sheet feeding failure is caused. Further, even if sheets can be fed, since insulation resistance is largely deteriorated, transferring ability of toner image is deteriorated and a failure image is prone to be generated.

To prevent a sheet from absorbing humidity, it is conventionally proposed a method in which a peripheral temperature of transfer sheets is increased to prevent the transfer sheets from absorbing humidity. As this method, there is a method in which under the high humidity environment, a dehumidification heater for increasing a temperature of a tray on which transfer sheets are stacked or a temperature of air in the apparatus is provided, thereby preventing the transfer sheets from absorbing humidity.

According to such a method, it is necessary to pass a current through the dehumidification heater and it is waste of electricity. Thus, there is also proposed to use a dehumidification unit including chemical absorbent (Japanese Patent Application Laid-open No. 9-44063).

There is also proposed a technique for conditioning humidity using a dehumidification member which can be thermally regenerated. According to this method, a desiccant type dehumidifier in which the dehumidification member absorbs humidity, the dehumidification member is heated and dried so that absorbed humidity is removed and the dehumidification member is regenerated is disposed in an image forming apparatus (Japanese Patent Application Laid-open No. 2005-77762).

According to the method using the dehumidification heater, however, it takes time to warm the peripheral environment of transfer sheets. In addition, even if the peripheral environment is warmed once and humidity of the transfer sheets is removed, if the sheet storage case is pulled out for adding transfer sheets or the like, outside air having high humidity enters, and it also takes time for again removing humidity from the transfer sheets which absorbed humidity. Therefore, there is a problem that it takes time before sheet feeding operation is started.

The method in which the desiccant type dehumidifier is incorporated in the image forming apparatus also has a problem that the dehumidification operation can not be started immediately before the dehumidification member is thermally regenerated, and it takes time for dehumidifying the transfer sheets.

SUMMARY OF THE INVENTION

The present invention provides a sheet feeder capable of capable of dehumidifying within a short time when a sheet is fed.

A sheet feeder of the present invention for achieving the above object comprises: a sheet storage case in which a sheet is stored, a humidity conditioning device which dehumidifies or moisturizes to condition humidity, an air tank in which air having humidity conditioned by the humidity conditioning device is stored, and a shutter which brings the air tank and the sheet storage case into communication and out of communication.

According to the present invention, since air stored in the air tank and whose humidity enters the sheet storage case by opening the shutter, it is possible to swiftly condition humidity in the sheet storage case. With this, the separating properties of sheets when a sheet is fed are enhanced, and it is possible to stably feed a sheet.

Further features of the present invention will become apparent from the following description of exemplary embodiments with reference to the attached drawings.

DESCRIPTION OF THE EMBODIMENTS

Next, a sheet feeder according to an embodiment of the present invention will be described. In the description, a copier is described as an image forming apparatus having the sheet feeder.

[Entire Structure of Image Forming Apparatus]

Figure 7:
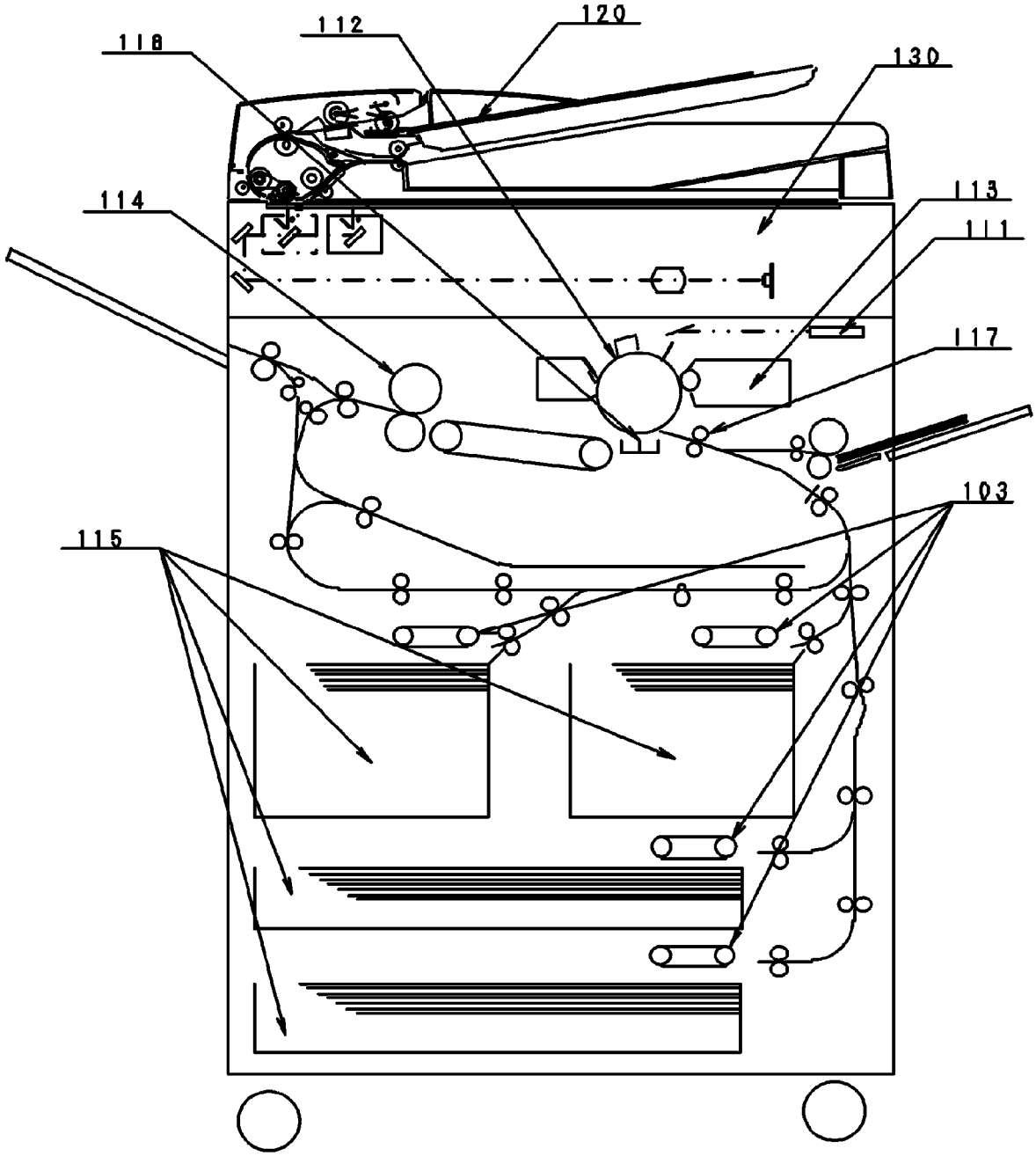
FIG. 7 is a schematic diagram of an image forming apparatus.

First, the entire structure of the image forming apparatus will be explained with reference to FIG. 7 together with an image forming operation. FIG. 7 is a schematic sectional view of the image forming apparatus having the sheet feeder according to the embodiment.

Originals are automatically sent to a reading portion by an original conveying portion 120, and image information is read by an image reading portion 130. The read image information is processed by a controller (not shown), and an image is formed in an electrophotograph type image forming portion. More specifically, laser light is emitted from a laser scanner unit 111, and an electrostatic latent image is formed on a photosensitive drum 112. The electrostatic latent image on the photosensitive drum is developed by a developing device 113. Sheets such as paper or OHT stored in a sheet storage case 115 are fed by a sheet feeder having a suction conveying belt 103, and a sheet is in synchronization with a toner image on the photosensitive drum in a registration portion 117, and an image is transferred onto the sheet in a transfer portion 118. The sheet is introduced into a pair of fixing rollers 114, the sheet is heated, pressurized and the image is permanently fixed to the sheet.

[Sheet Feeder]

Figure 1:
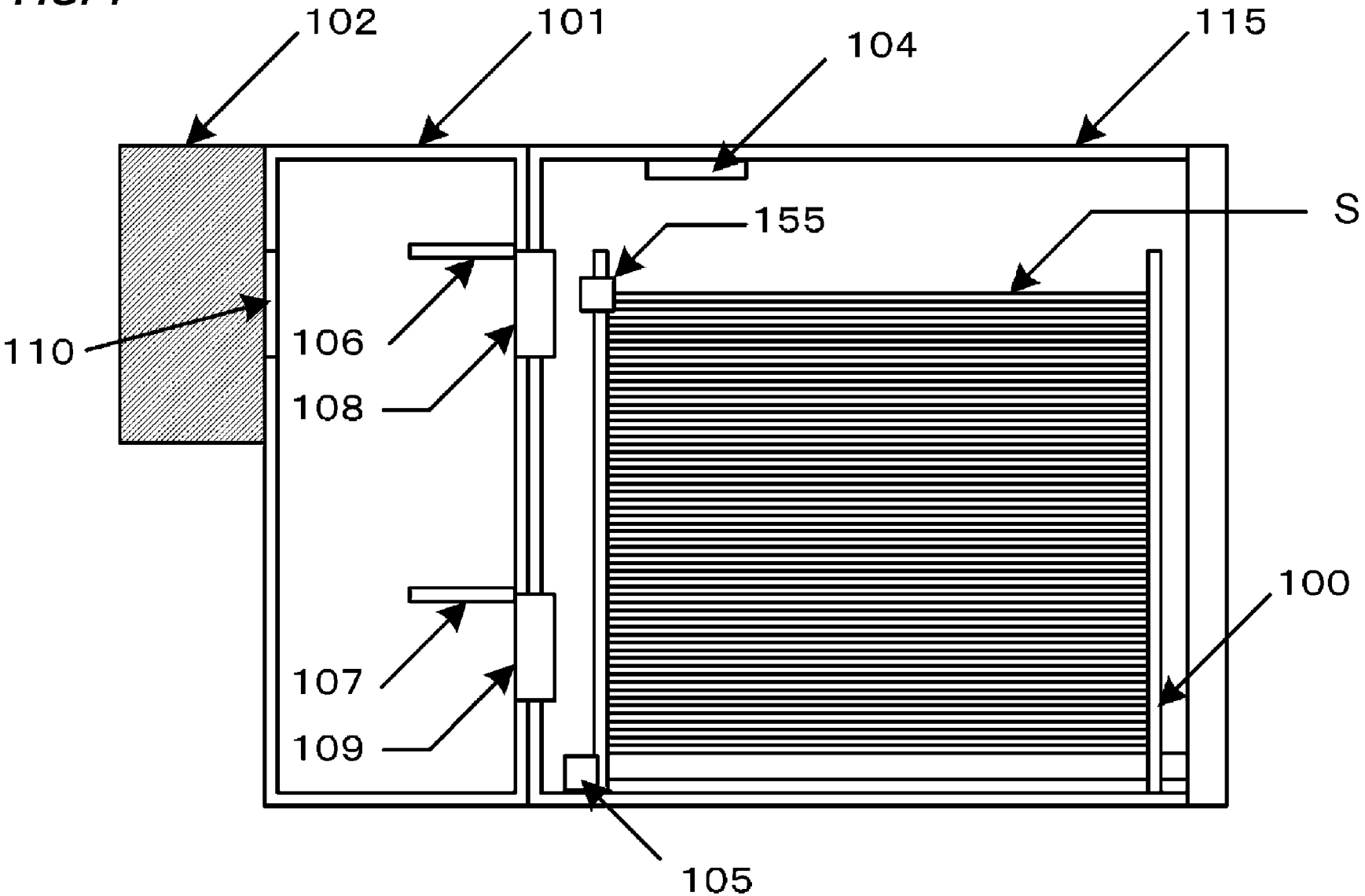
FIG. 1 is a schematic sectional view of a sheet feeder.
Figure 2:
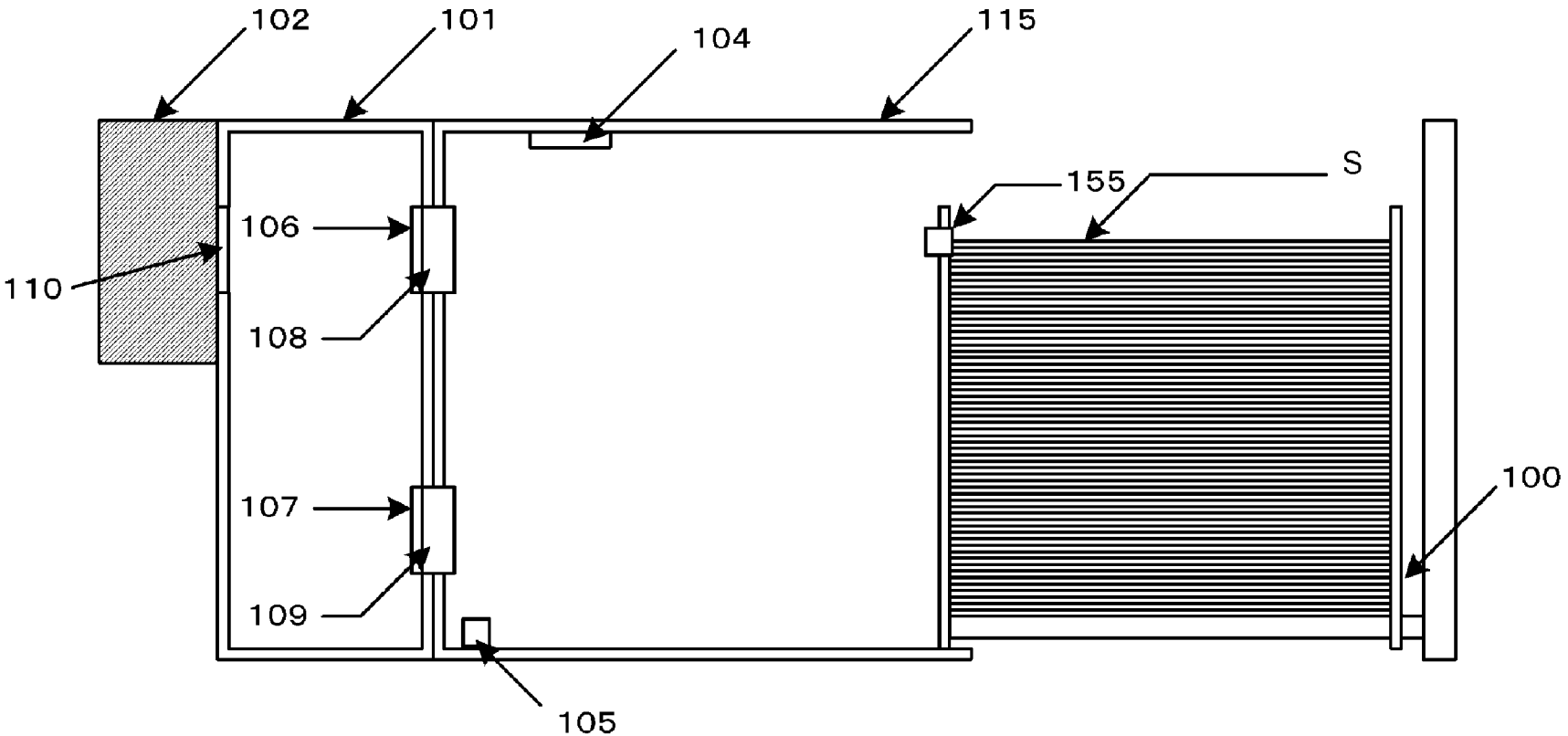
FIG. 2 is a schematic sectional view of the sheet feeder.

FIGS. 1 and 2 are schematic sectional views of the sheet feeder to which the present invention is applied.

Sheets S to be supplied to the image forming portion are stored in a sheet storage case 115. A humidity conditioning device 102 conditions humidity in the sheet storage case 115 of the embodiment. An air tank 101 is disposed between the sheet storage case 115 and the humidity conditioning device 102. The air tank 101 is a closed space which is also used as an electrical equipment area in which a control substrate and the like (not shown) are disposed. Thus, the image forming apparatus is not increased in size. The air tank may be used only as the air tank and may not be used as the electrical equipment area.

The humidity conditioning device 102 and the air tank 101 are connected to each other through a humidity conditioning device connecting portion 110, and air whose humidity is conditioned is discharged from the humidity conditioning device 102 into the air tank 101. The air tank 101 and the sheet storage case 115 are connected to each other through two openings which can be opened and closed by a first shutter 106 and a second shutter 107.

If the first and second shutters 106 and 107 are opened, the air tank 101 and the sheet storage case 115 can be brought into communication and air can pass therebetween, and if the first and second shutters 106 and 107 are closed, the communication of air between the air tank 101 and the sheet storage case 115 is cut.

A first fan 108 is provided at the opening where the first shutter 106 exists, a second fan 109 is provided at the opening where the second shutter 107 exists, and air can be sent through the fans. The first fan 108 discharges air in the air tank 101 into the sheet storage case 115, and the second fan 109 discharges air in the sheet storage case 115 into the air tank 101. The number of fans is not limited to two, and the number may be changed in accordance with necessity.

Sheets S are stacked and stored in a sheet stacking portion (tray) 100, and the sheet stacking portion 100 can be pulled out from the sheet storage case 115. A storage case opening/closing detection sensor 105 as an opening/closing detection member detects an opening/closing state whether the sheet storage case 115 is attached. A sheet detection sensor 155 as a sheet detection member detects whether a sheet S exists on the sheet stacking portion 100 in the storage case. A humidity sensor 104 as a humidity detection member detects humidity in the sheet storage case.

[Humidity Conditioning Device]

Figure 3:
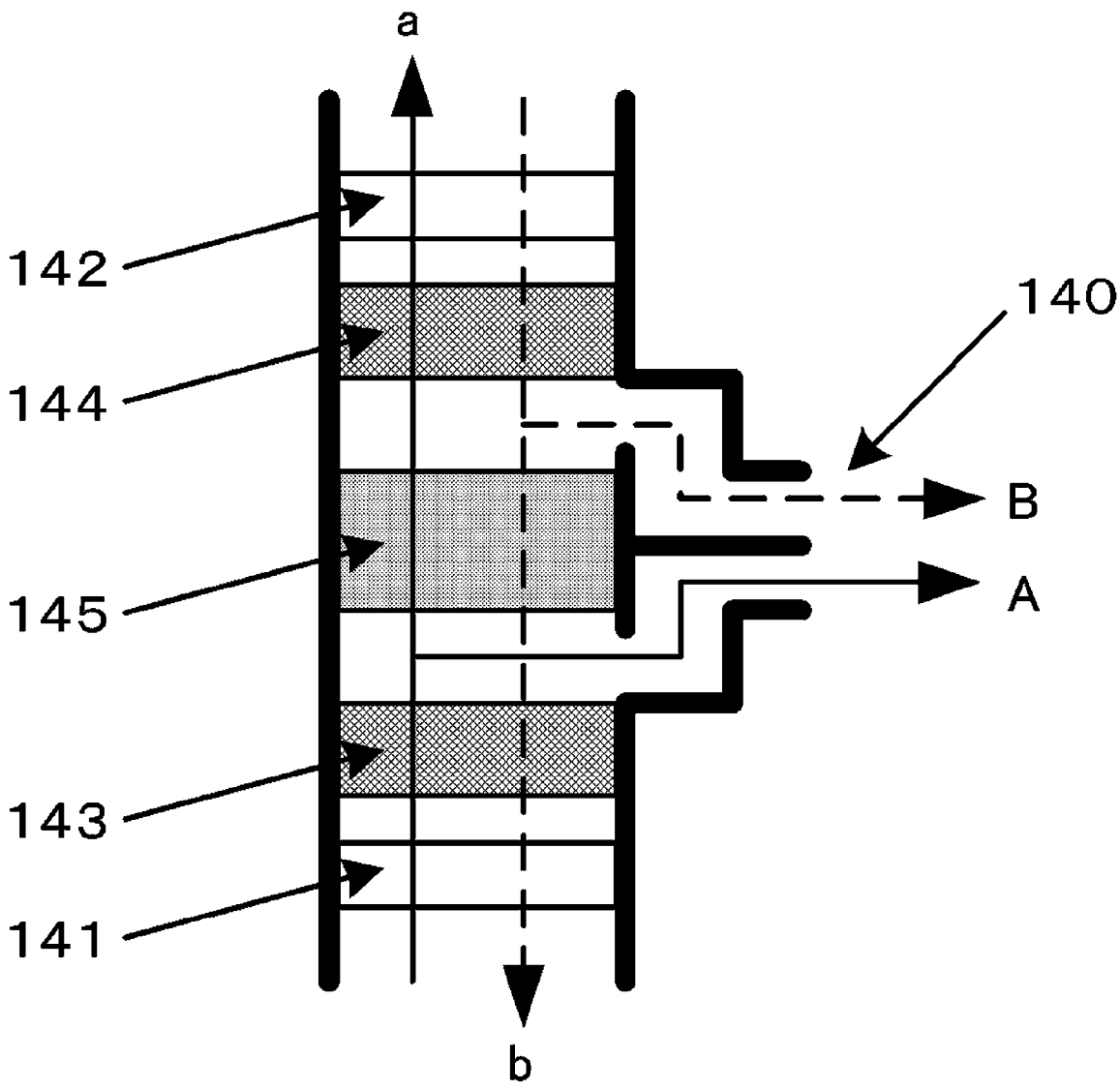
FIG. 3 is a schematic sectional view illustrating a structure example of a desiccant type dehumidifier.

The sheet feeder of the embodiment has a humidity conditioning device which reduces or increases humidity, thereby conditioning humidity. With this, humidity in the sheet storage case 115 can be conditioned. FIG. 3 is a schematic sectional view showing a structure example of a desiccant type humidity conditioning device as one example of the humidity conditioning device.

A concrete example of the humidity conditioning device 102 will be described using FIG. 3. In the humidity conditioning device 102, thermally regeneration type dehumidification members 143 and 144 are used. Even if the dehumidification members 143 and 144 once absorb humidity, the dehumidification ability is restored if they are heated. First, air outside the apparatus is sprayed to the first dehumidification member 143 by the first dehumidification fan 141. The first dehumidification member 143 made of zeolite or silica gel absorbs moisture in the air, and discharges dehumidified air is discharged in the direction of the arrow A from a dry air injection port 140. If the dehumidification ability of the first dehumidification member 143 is saturated after predetermined time, the first dehumidification fan 141 is stopped.

Next, the second dehumidification fan 142 is driven, air outside the apparatus is sprayed to a second dehumidification member 144, moisture in the air is absorbed by the second dehumidification member 144, and the dehumidified air is discharged in the direction of the arrow B from the dry air injection port 140.

A heater 145 removes moisture in the second dehumidification member 144 by air flow a caused by the first dehumidification fan 141 when the first dehumidification fan 141 is driven, and high humidity air is discharged. When the second dehumidification fan 142 is driven on the contrary, moisture in the first dehumidification member 143 is removed by air flow b caused by the second dehumidification fan 142, and high humidity air is discharged. With this structure, dehumidified air or high humidity air can be obtained, and the air tank 101 is filled with dehumidified air or high humidity air as required.

Figure 4:
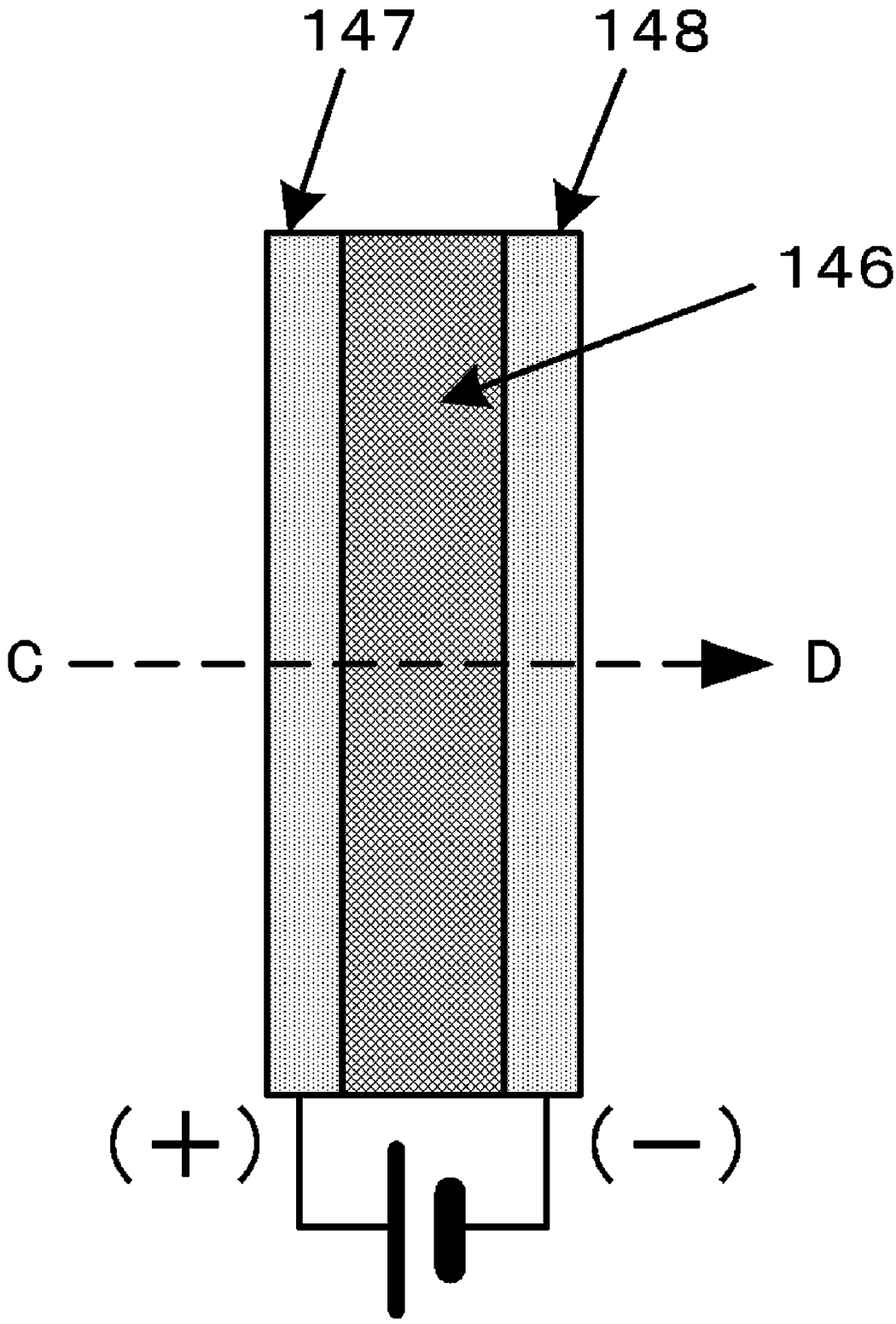
FIG. 4 is a schematic sectional view illustrating a structure example of a dehumidifier using a solid polymer electrolyte membrane.

As another example of the humidity conditioning device, a humidity conditioning device having a structure shown in FIG. 4 can also be used. FIG. 4 is a schematic sectional view showing a structure example of the humidity conditioning device of a type in which DC voltage is supplied to porous electrodes provided on both sides of a solid polymer electrolyte membrane to adjust the humidity. The structure will be explained.

A porous electrode 147 connected to an anode and a porous electrode 148 connected to a cathode are provided on both sides of the solid polymer electrolyte membrane 146, thereby constituting the humidity conditioning device 102. If voltage is applied to the porous electrodes, water molecule (H2O) in the air is decomposed into hydrogen ion (H+), oxygen molecule (O2) and electron ($e^-$) on the side of the porous electrode 147 connected to the anode. The hydrogen ion passes the solid polymer electrolyte membrane 146, and moves toward the porous electrode 148 connected to the cathode, the hydrogen ion is coupled to oxygen molecule in the air, they become water molecule and discharged into the air. That is, dehumidification is carried out on the side C of the porous electrode 147 connected to the anode, and air is moisturized on the side D of the porous electrode 148 connected to the cathode. With this structure, dehumidified air or high humidity air is obtained, and the air tank 101 is filled with dehumidified air or high humidity air as required.

As the humidity conditioning device 102, the humidity conditioning device using the thermal regeneration type dehumidification members 143 and 144 shown in FIG. 3, or the humidity conditioning device of the type in which DC voltage is applied to the porous electrodes provided on both sides of the solid polymer electrolyte membrane shown in FIG. 4 is used, but the present invention is not limited to this. A pair of humidity conditioning devices are used, one is used for charging dehumidified air into the air tank 101 and the other is used for charging moisturized air into the air tank 101, and dehumidified air or moisturized air is supplied as required. A discharge port for dehumidified air and a discharge port for moisturized air from one humidity conditioning device may be switched using a valve such that the ports can be connected to the air tank 101 as required.

[Control Section]

Figure 5:
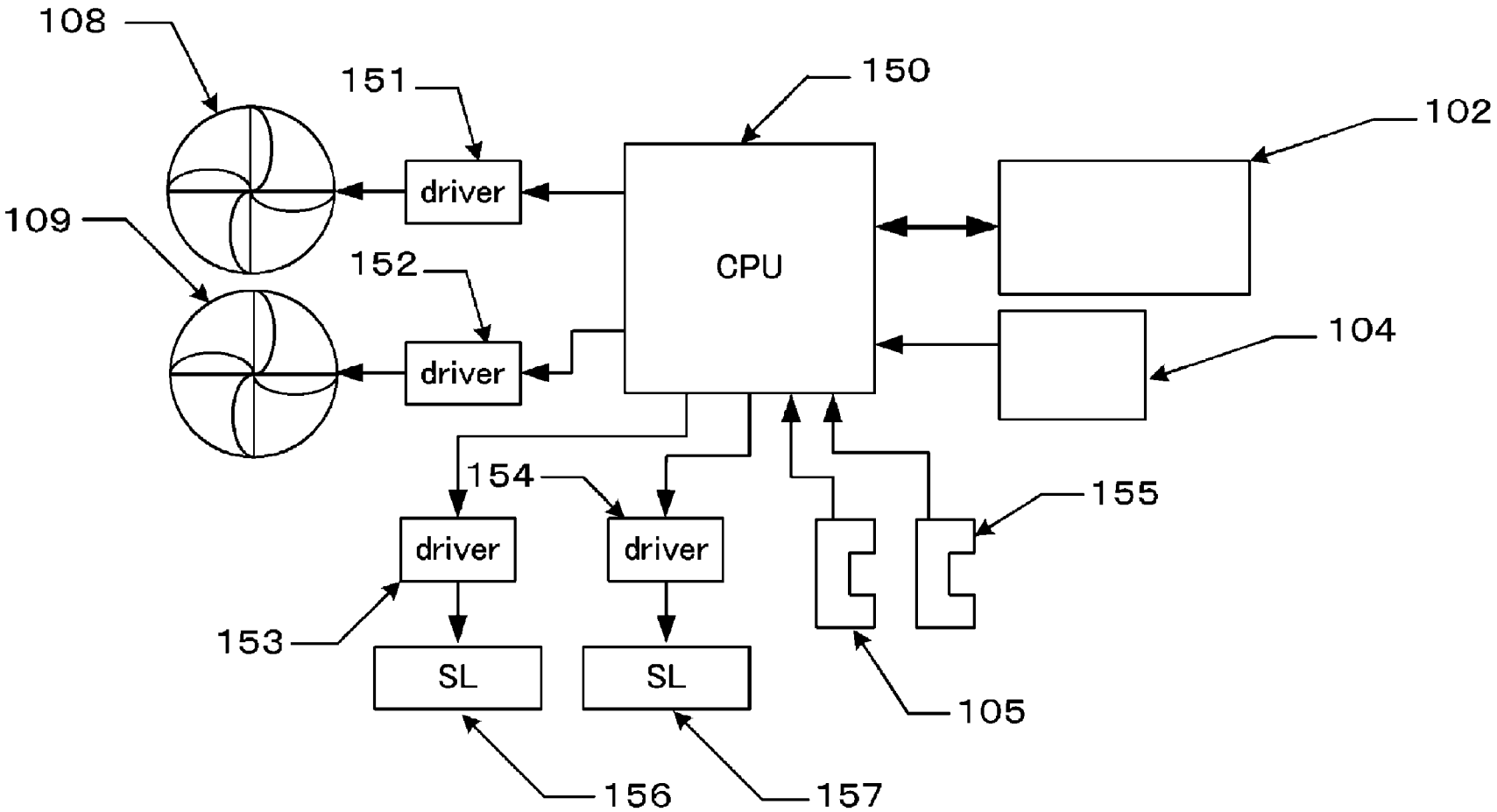
FIG. 5 is a diagram for explaining a circuit block structure of the sheet feeder.

FIG. 5 is a diagram for explaining a circuit block structure of the sheet feeder according to the embodiment. A CPU 150 controls the sheet feeder. The sheet storage case 115 and the humidity conditioning device 102 are connected to the CPU 150, and ON/OFF of the humidity conditioning device 102 and mode setting are carried out. The CPU 150 outputs a drive start command to drive circuits which drives loads of the sheet feeder, and the CPU 150 receives output signals from various sensors of the sheet feeder such as the storage case opening/closing detection sensor 105, the sheet detection sensor 155 and the humidity sensor 104. A drive circuit 151 turns the first fan 108 ON and OFF, and a drive circuit 152 turns the second fan 109 ON and OFF. Drive circuits 153 and 154 of solenoids 156 and 157 open and close the first shutter 106 and the second shutter 107 provided at the opening between the sheet storage case 115 and the air tank 101. Although the different solenoids 156 and 157 are used for opening and closing the two shutters 106 and 107 in this embodiment, there is no problem even if the shutters are opened and closed using one solenoid.

[Humidity Conditioning Operation]

Figure 6:
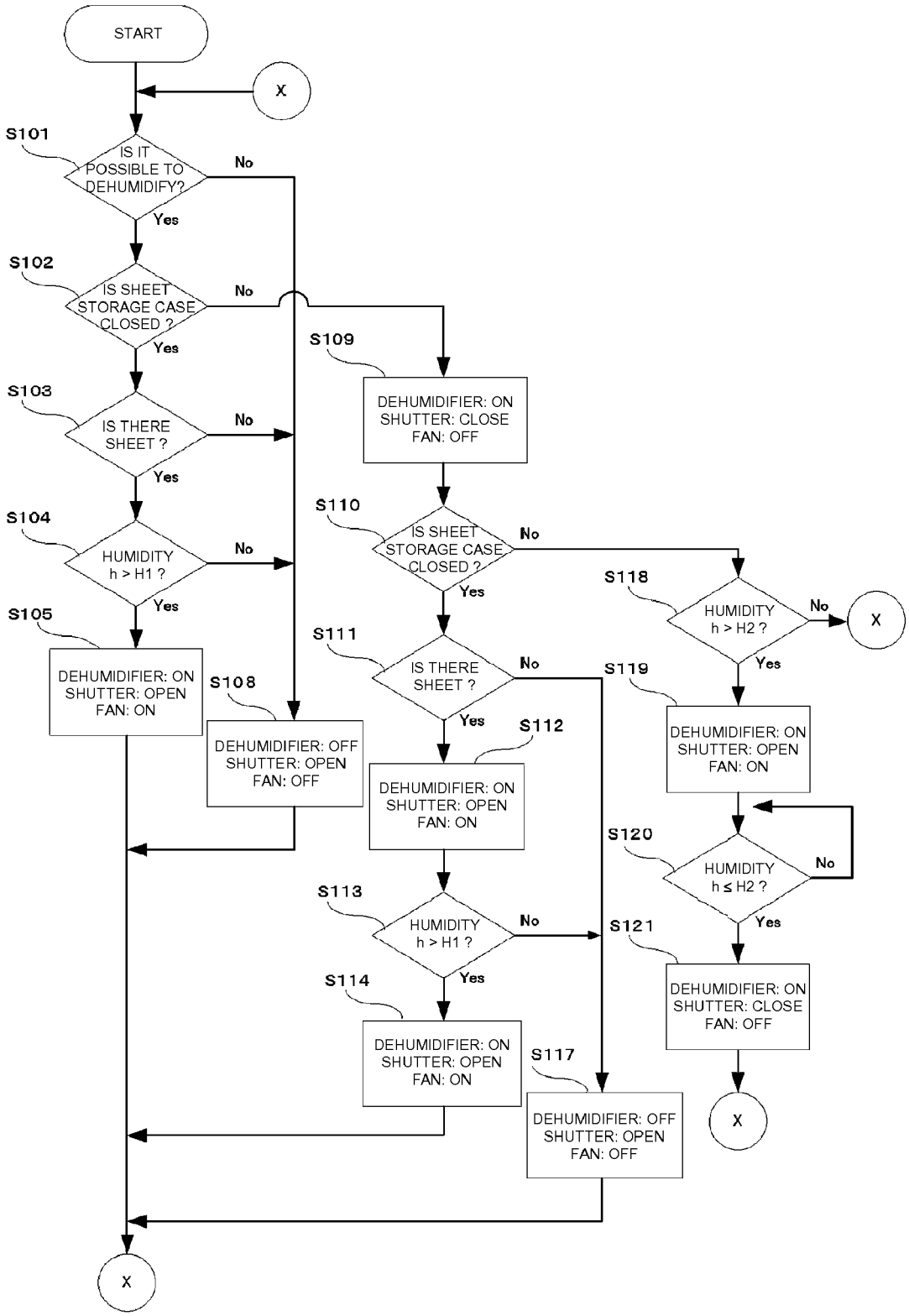
FIG. 6 is a flowchart of the sheet feeder.

FIG. 6 is a flowchart of operation of the sheet feeder according to the embodiment. As the humidity conditioning method in the sheet storage case of the sheet feeder according to the embodiment will be described using the flowchart based on an example in which air is dehumidified. Here, a target humidity h is h≦H1 such that humidity h at which separation properties of sheets are enhanced when a sheet is fed becomes equal to or lower than humidity H1. A target humidity h in the sheet storage case in a state where the sheet storage case is opened is h≦H2. The humidity H2 is defined as follows; if the humidity h exceeds this value H2, the sheet storage case 115 is closed, and even if dehumidification in the humidity conditioning device 102 and the air tank is carried out using dehumidified air, it is difficult to lower the humidity less than the target value H1 within predetermined time.

First, it is determined whether the dehumidification operation can be carried out (S101). This is determination whether a mode of the apparatus is in a low electricity mode at which dehumidification operation can not be carried out because it is necessary to limit the electricity as the apparatus. If it is determined that the dehumidification operation can not be carried out, the procedure is advanced to S108, the operation of the humidity conditioning device 102 is stopped, the first fan 108 and the second fan 109 are turned OFF, and the first shutter 106 and the second shutter 107 are opened.

If it is determined that the dehumidification can be carried out, it is determined whether the sheet storage case 115 is closed (S102). The open/close state of the sheet storage case 115 is detected by the storage case opening/closing detection sensor 105, and it is determined whether the sheet storage case 115 is closed.

If it is determined that the sheet storage case 115 is closed, it is determined whether there is a sheet in the sheet storage case 115 (S103). It is detected whether there is a sheet on the sheet stacking portion 100 in the sheet storage case 115 by the sheet detection sensor 155 disposed in the storage case. If it is determined that there is no sheet in the sheet storage case 115, the procedure is advanced to S108.

If it is determined that there is a sheet in the sheet storage case 115, the procedure is advanced to S104. In S104, it is determined whether the humidity h in the sheet storage case 115 is higher than the set humidity H1. At that time, if the humidity h detected based on an A/D conversion value from the humidity sensor 104 is higher than the set humidity H1, it is determined that the humidity in the sheet storage case 115 is high and dehumidification is required. At that time, the first and second shutters 106 and 107 are opened, the first and second fans 108 and 109 are turned ON, the humidity conditioning device 102 is operated and dehumidification in the sheet storage case is carried out (S105).

When the humidity h in the sheet storage case 115 is equal to or lower than the set humidity H1, it is determined that the humidity in the sheet storage case 115 reaches the target humidity, the procedure is advanced to S108, and dehumidification is not carried out.

In S102, if the sheet storage case 115 is not closed, the first and second shutters 106 and 107 are closed, the first and second fans 108 and 109 are turned OFF and the humidity conditioning device 102 is operated. With this, air in the air tank is dehumidified, and low humidity air is charged into the air tank 101 (S109).

Next, it is again determined whether the sheet storage case 115 is closed in S110. If the sheet storage case 115 is closed, it is determined whether there is a sheet in the sheet storage case 115 (S111). If it is determined that there is no sheet in the sheet storage case 115, the procedure is advanced to S117, and the dehumidification is completed. When it is determined that there is a sheet in the sheet storage case 115, the procedure is advanced to S112. In S112, the humidity conditioning device 102 is operated, the first and second shutters 106 and 107 are opened and the first and second fans 108 and 109 are turned ON. With this, low humidity air in the air tank 101 which is dehumidified S109 is charged into the sheet storage case 115, and dehumidification in the sheet storage case 115 can be carried out swiftly.

Next, it is determined in S113 whether the humidity h is higher than H1. If the humidity h is higher than the predetermined humidity H1, it is determined that the humidity in the sheet storage case 115 is high and dehumidification is necessary, the first and second shutters 106 and 107 are left opened, and the dehumidification is continued in a state where the first and second fans 108 and 109 are ON (S114). If the humidity h is equal to or lower than the predetermined humidity H1, it is determined that the humidity in the sheet storage case 115 reaches the target humidity, the procedure is advanced to S117 and the dehumidification operation is completed.

When the sheet storage case 115 is not closed in S110, the procedure is advanced to S118. In S118, it is determined whether humidity h in the sheet storage case 115 in a state where the sheet storage case 115 is opened is higher than H2. At that time, if the detected humidity h is higher than the predetermined humidity H2, it is determined that although the sheet storage case 115 is opened, it is difficult to bring the humidity less than the target humidity H1 within predetermined time even if the sheet storage case 115 is closed, and it is necessary to carry out dehumidification in the sheet storage case 115. Thus, the humidity conditioning device 102 is operated, the first and second shutters 106 and 107 are opened and the first and second fans 108 and 109 are turned ON (S119).

If the humidity h in the sheet storage case 115 is equal to or lower than H2, it is determined that it is unnecessary to dehumidify the sheet storage case 115, and the procedure is returned to sequence of immediately after the start.

In S120, the monitoring operation is continued until the humidity h in the sheet storage case 115 becomes equal to or lower than H2. If the humidity becomes equal to or lower than H2, the procedure is advanced to S121, the first and second shutters 106 and 107 are closed, and the humidity conditioning device 102 is operated in a state where the first and second fans 108 and 109 are turned OFF. With this, dehumidification in the air tank 101 is carried out, and the air tank 101 is filled with low humidity air. Then, the procedure is returned to sequence of immediately after the start.

In the embodiment, although the dehumidification method in the sheet storage case using the humidity conditioning device is described, but when the humidity in the sheet storage case is too low, high humidity air is supplied into the sheet storage case and air is moisturized. This moisturizing method is the same as the dehumidification method.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structure and functions.

This application claims the benefit of Japanese Patent Application No. 2007-230879, filed Sep. 6, 2007, which is hereby incorporated by reference herein in its entirety.

What is claimed is:

1. A sheet feeder comprising:

a sheet storage case in which a sheet is stored, a humidity conditioning device which dehumidifies or moisturizes to condition humidity, an air tank in which air having humidity conditioned by the humidity conditioning device is stored, and a shutter which brings the air tank and the sheet storage case into communication and out of communication.

2. The sheet feeder according to claim 1, further comprising an open/close detection member which detects an open/close state of the sheet storage case, wherein in a state where the sheet storage case is opened, the shutter is closed and air in the air tank is conditioned by the humidity conditioning device, and in a state where the sheet storage case is closed, the shutter is opened and humidity in the sheet storage case is conditioned using air in the air tank.

3. The sheet feeder according to claim 1, further comprising:

an open/close detection member which detects an open/close state of the sheet storage case, a sheet detection member which detects whether there is a sheet in the sheet storage case, humidity detection member which detects humidity in the sheet storage case, and a control section which operates the shutter in accordance with the open/close state of the sheet storage case, in accordance with whether there is a sheet in the sheet storage case, and in accordance with humidity in the sheet storage case.

4. The sheet feeder according to claim 1, further comprising:

a fan which sends air between the air tank and the sheet storage case.

5. The sheet feeder according to claim 4, wherein the fan comprises a fan which operates to discharge air in the air tank into the sheet storage case, and a fan which operates to discharge air in the sheet storage case into the air tank.

6. The sheet feeder according to claim 1, wherein the air tank also functions as an electrical equipment area in which a control substrate is disposed.

7. The sheet feeder according to claim 1, wherein the humidity conditioning device conditions humidity using a thermal regeneration type dehumidification member.

8. The sheet feeder according to claim 1, wherein the humidity conditioning device dehumidifies or moisturizes by applying DC voltage to porous electrodes provided on both sides of a solid polymer electrolyte membrane, to condition humidity.

9. An image forming apparatus which feeds a sheet and forms an image comprising:

the sheet feeder described in claim 1, and an image forming portion which forms an image on a sheet sent out from the sheet feeder.

* * * * *